US012516480B2

(12) United States Patent
Wenzelmann et al.

(10) Patent No.: US 12,516,480 B2
(45) Date of Patent: Jan. 6, 2026

(54) SLIPFORM PAVER WITH SUSPENDED ADJUSTABLE WIDTH MOLD

(71) Applicant: Wirtgen GmbH, Windhagen (DE)

(72) Inventors: Harry Wenzelmann, Alpenrod (DE); Christian Liß, Meckenheim (DE)

(73) Assignee: Wirtgen GmbH, Windhagen (DE)

( * ) Notice: Subject to any disclaimer, the term of this patent is extended or adjusted under 35 U.S.C. 154(b) by 961 days.

(21) Appl. No.: 17/701,182

(22) Filed: Mar. 22, 2022

(65) Prior Publication Data

US 2023/0304232 A1 Sep. 28, 2023

(51) Int. Cl.
*E01C 19/48* (2006.01)

(52) U.S. Cl.
CPC ..... *E01C 19/4893* (2013.01)

(58) Field of Classification Search
CPC ..... E01C 19/4893; E01C 19/40; E01C 19/42; E01C 19/43; E01C 19/48; E01C 2301/14; E01C 2301/18
See application file for complete search history.

(56) References Cited

U.S. PATENT DOCUMENTS

| | | | | |
|---|---|---|---|---|
| 1,782,707 | A | 11/1930 | Bayley | |
| 3,970,405 | A | 7/1976 | Swisher, Jr. et al. | |
| 4,197,032 | A | 4/1980 | Miller | |
| 4,379,653 | A | 4/1983 | Brown | |
| 4,586,889 | A | 5/1986 | Krohne et al. | |
| 4,678,365 | A | 7/1987 | Ban et al. | |
| 4,778,305 | A | 10/1988 | Ritchey et al. | |
| 4,789,266 | A | 12/1988 | Clarke et al. | |
| 4,808,026 | A * | 2/1989 | Clarke, Jr. | E01C 19/187 404/90 |
| 4,900,186 | A | 2/1990 | Swisher et al. | |
| 5,590,977 | A | 1/1997 | Guntert et al. | |
| 5,615,972 | A | 4/1997 | Guntert et al. | |
| 5,647,688 | A | 7/1997 | Guntert et al. | |
| 5,941,658 | A | 8/1999 | Dahlinger et al. | |
| 6,022,170 | A | 2/2000 | Rower | |
| 6,390,728 | B1 | 5/2002 | Casters | |

(Continued)

FOREIGN PATENT DOCUMENTS

| | | | |
|---|---|---|---|
| DE | 19814052 | A1 | 10/1999 |
| EP | 1213389 | A1 | 6/2002 |

(Continued)

OTHER PUBLICATIONS

CMI 2000 Series HVW Hydraulic Variable-Width Slipform Pavers brochure, CMI Corporation, Oklahoma City U.S.A., 6 pages (dated at least as early as Apr. 8, 2001).

(Continued)

*Primary Examiner* — Abigail A Risic
(74) *Attorney, Agent, or Firm* — Lucian Wayne Beavers; Patterson Intellectual Property Law, PC

(57) ABSTRACT

An adjustable width mold apparatus for a slipform paver includes a center portion and left and right sideform assemblies. The left and right sideform assemblies are movably mounted on a machine frame. Left and right actuators can independently move the left and right sideform assemblies relative to the machine frame. A mold width of the mold is adjustable without adjusting a width of the machine frame. The mold can be laterally shifted in position relative to the machine frame.

15 Claims, 13 Drawing Sheets

(56) References Cited

U.S. PATENT DOCUMENTS

| | | | | |
|---|---|---|---|---|
| 6,471,442 | B1 | 10/2002 | Deeb et al. | |
| 6,497,531 | B2 | 12/2002 | Sipherd et al. | |
| 6,582,152 | B2 * | 6/2003 | Leone | E01C 19/42 404/105 |
| 6,872,028 | B2 | 3/2005 | Aeschlimann et al. | |
| 6,890,123 | B2 | 5/2005 | Piccoli | |
| 7,651,295 | B2 | 1/2010 | Eppes et al. | |
| 7,950,874 | B2 * | 5/2011 | Guntert, Jr. | E01C 19/42 404/105 |
| 8,128,314 | B2 * | 3/2012 | Buschmann | E01C 19/48 404/104 |
| 8,267,619 | B2 * | 9/2012 | Munz | E01C 19/48 404/101 |
| 8,967,908 | B1 * | 3/2015 | Thieme | E01C 19/40 404/75 |
| 9,121,141 | B2 | 9/2015 | Thieme et al. | |
| 10,370,801 | B2 * | 8/2019 | Pinson | E01C 19/48 |
| 11,162,233 | B2 | 11/2021 | Wenzelmann | |
| 2003/0185626 | A1 * | 10/2003 | Aeschlimann | E01C 19/40 404/105 |
| 2007/0258769 | A1 * | 11/2007 | Eppes | E01C 19/48 404/118 |
| 2018/0155883 | A1 * | 6/2018 | Engels | E01C 19/4893 |
| 2021/0172131 | A1 | 6/2021 | Wenzelmann et al. | |

FOREIGN PATENT DOCUMENTS

| | | | | |
|---|---|---|---|---|
| EP | 3333318 | A1 | 6/2018 | |
| EP | 4239127 | A2 * | 9/2023 | E01C 19/48 |
| WO | 9528525 | A1 | 10/1995 | |
| WO | 9704176 | A1 | 2/1997 | |
| WO | 9950503 | A1 | 10/1999 | |
| WO | 02101150 | A1 | 12/2002 | |
| WO | 2010120722 | A1 | 10/2010 | |

OTHER PUBLICATIONS

CMI 2000 Series Paving Kit Arrangements brochure, CMI Corporation, P.O. Box 1985, Oklahoma City, OK 73101 USA, 2 pages (dated at least as early as Apr. 8, 2001).

CMI 2000 Series HVW Models SF-2103, SF-2104 and SF-2204 brochure, CMI Corporation U.S.A., P.O. Box 1985, Oklahoma City, OK 73101, 16 pages (dated at least as early as Apr. 8, 2001).

European Search Report for corresponding patent application No. EP 23163548, dated Aug. 10, 2023, 3 pages (not prior art).

* cited by examiner

SLIPFORM PAVER WITH SUSPENDED ADJUSTABLE WIDTH MOLD

BACKGROUND OF THE INVENTION

1. Field of the Invention

The present application relates to a slipform paver, and more specifically to a slipform paver including an adjustable width mold apparatus.

2. Description of the Prior Art

A slipform paving machine is designed to move in a paving direction across a ground surface and form concrete into a finished concrete structure. A typical slipform paver machine may be seen in U.S. Pat. No. 6,872,028 (WO 2002/101150) to Aeschlimann et al. Machines like that of Aeschlimann et al. have a machine frame with an adjustable frame width.

It is also known to provide adjustable width molds for use with adjustable width paving machines. Examples of such adjustable width molds may be seen in Guntert U.S. Pat. No. 7,950,874 and Thieme U.S. Pat. No. 9,121,141. These adjustable width molds have their end portions fixed to the machine frame of the paving machine such that the mold width is adjusted with the machine frame width.

There is a continuing need for improvements in adjustable width paving machines and adjustable width molds.

SUMMARY OF THE INVENTION

In one embodiment an inset slipform paver includes a machine frame, at least one left ground-engaging unit and at least one right ground engaging unit configured to support the machine frame from a ground surface along left and right support paths such that a forward operating direction of the machine frame is defined and such that the machine frame has a frame width transverse to the forward operating direction, and an adjustable width mold suspended from the machine frame between the left and right support paths such that a mold width of the adjustable width mold is adjustable without adjusting the frame width of the machine frame.

The adjustable width mold may include a center portion, a left sideform assembly, and a right sideform assembly.

The adjustable width mold may include one or more left spacers configured to be received between the left sideform assembly and the center portion and one or more right spacers configured to be received between the right sideform assembly and the center portion.

The adjustable width mold may include a left side mold actuator connected between the left sideform assembly and the center portion to move the left sideform assembly relative to the center portion and a right side mold actuator connected between the right sideform assembly and the center portion to move the right sideform assembly relative to the center portion.

The slipform paver may further include a left suspension assembly suspending the left sideform assembly from the machine frame such that the left sideform assembly is movable relative to the machine frame and a right suspension assembly suspending the right sideform assembly from the machine frame such that the right sideform assembly is movable relative to the machine frame.

The left suspension assembly may include a left suspension frame fixedly attached to the machine frame and including a guide, a left carriage movably engaged with the guide so that the left carriage is movable relative to the left suspension frame along the guide, the left carriage being connected to the left sideform assembly, and a left suspension actuator configured to move the left carriage and the left sideform assembly relative to the machine frame. The right suspension assembly may include a similar suspension frame, carriage and suspension actuator.

The center portion may be configured to provide an adjustable crown angle, and the left carriage may be pivotably connected to the left suspension assembly to accommodate the crown angle. The right carriage may also be pivotably connected to the right suspension assembly to accommodate the crown angle.

Each of the suspension assemblies may include a clamping cylinder configured to lock the carriage in place relative to the suspension frame. Each suspension assembly may include more than one clamping cylinder.

The slipform paver may include a controller operably associated with the left and right suspension actuators, the controller being configured such that a human operator can select between;

- a left side operational mode in which the left suspension actuator is operable to move the left carriage and the left sideform assembly relative to the machine frame while the right carriage and right sideform assembly remain fixed relative to the machine frame;
- a right side operational mode in which the right suspension actuator is operable to move the right carriage and the right sideform assembly relative to the machine frame while the left carriage and left sideform assembly remain fixed relative to the machine frame; and
- a mold shifting operational mode in which one of the left and right suspension actuators extends while the other of the left and right suspension actuators retracts to transversely shift a position of the mold relative to the machine frame without adjusting the mold width.

The left suspension assembly may further include at least one left clamping cylinder configured to have a locked position locking the left carriage in place relative to the left suspension frame and the right suspension assembly may further include at least one right clamping cylinder configured to have a locked position locking the right carriage in place relative to the right suspension frame. The controller may be configured such that: during the left side operational mode the left clamping cylinder is released to unlock the left carriage and the right clamping cylinder is in the locked position; during the right side operational mode the right clamping cylinder is released to unlock the right carriage and the left clamping cylinder is in the locked position; and during the mold shifting mode both the left and right clamping cylinders are released to unlock the left and right carriages.

The suspension actuators may be hydraulic smart cylinders.

The adjustable width mold may include a first mold actuator connected between the center portion and one of the left and right sideform assemblies to move the one of the left and right sideform assemblies relative to the center portion. The mold may further include a first suspension assembly including a first carriage movably mounted on the machine frame such that the first carriage is laterally movable relative to the machine frame, the first carriage being connected to the one of the left and right sideform assemblies and a first suspension actuator configured to move the first carriage and the one of the left and right sideform assemblies relative to the machine frame. The mold may further include a controller operably associated with the first mold actuator and with the first suspension actuator, the controller being configured to coordinate operation of the first mold actuator with the first suspension actuator so that the first mold actuator and the first suspension actuator operate together to move the first carriage and the one of the left left and right sideform assemblies relative to the machine frame.

In another embodiment an inset slipform paver may include a machine frame, at least one left ground-engaging unit and at least one right ground engaging unit configured to support the machine frame from a ground surface, an adjustable width mold including a left sideform assembly, a center portion and a right sideform assembly, and a first suspension assembly. The first suspension assembly may include a first carriage movably mounted on the machine frame such that the first carriage is laterally movable relative to the machine frame, the first carriage being connected to one of the left and right sideform assemblies and a first suspension actuator configured to move the first carriage and the one of the left and right sideform assemblies relative to the machine frame.

The slipform paver may also include a second suspension assembly including a second carriage movably mounted on the machine frame such that the second carriage is laterally movable relative to the machine frame, the second carriage being connected to the other of the left and right sideform assemblies and a second suspension actuator configured to move the second carriage and the other of the left and right sideform assemblies relative to the machine frame.

The slipform paver may further include a controller operably associated with the first and second suspension actuators, the controller being configured such that each of the first and second suspension actuators are independently operable to move the associated one of the left and right sideform assemblies relative to the machine frame to adjust a width of the mold.

The controller may be further configured such that both of the first and second suspension actuators are simultaneously operable to laterally shift the mold relative to the machine frame without adjusting the width of the mold.

In another embodiment a method of adjusting a width of a mold of a slipform paver, the slipform paver including an adjustable width machine frame supported on a plurality of ground engaging units includes a step of adjusting the width of the mold without adjusting the width of the machine frame.

The method may further include laterally shifting a position of the mold relative to the machine frame without adjusting the width of the machine frame.

The adjusting step may further include laterally moving a sideform assembly of the mold relative to a center portion of the mold without adjusting the width of the machine frame.

The adjusting step may be performed under control of a controller.

Numerous objects, features and advantages of the embodiments set forth herein will be readily apparent to those skilled in the art upon reading of the following disclosure when taken in conjunction with the accompanying drawings.

DETAILED DESCRIPTION

Figure 1:
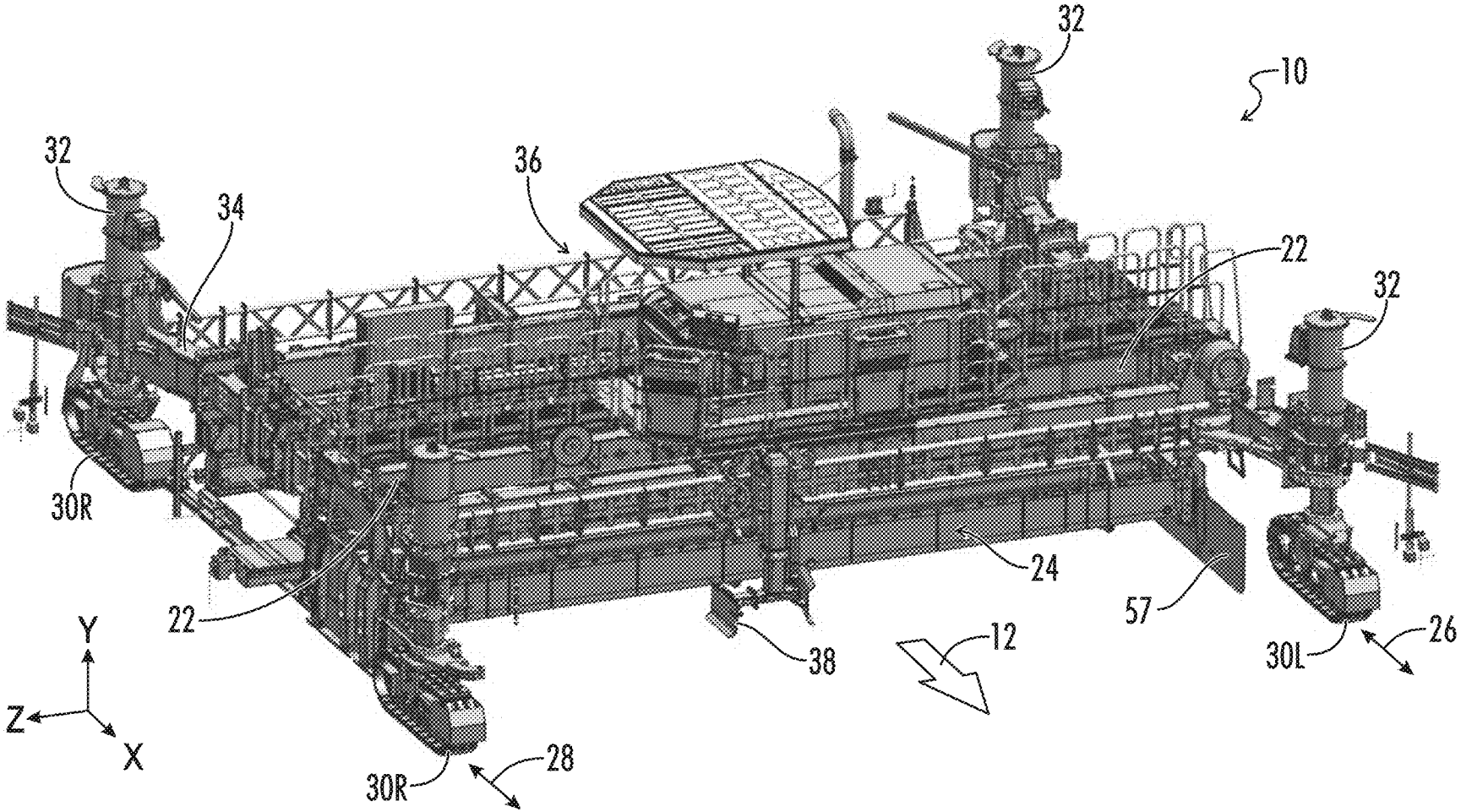
FIG. 1 is a front perspective view of a slipform paver including one embodiment of the adjustable width mold apparatus.
Figure 2:
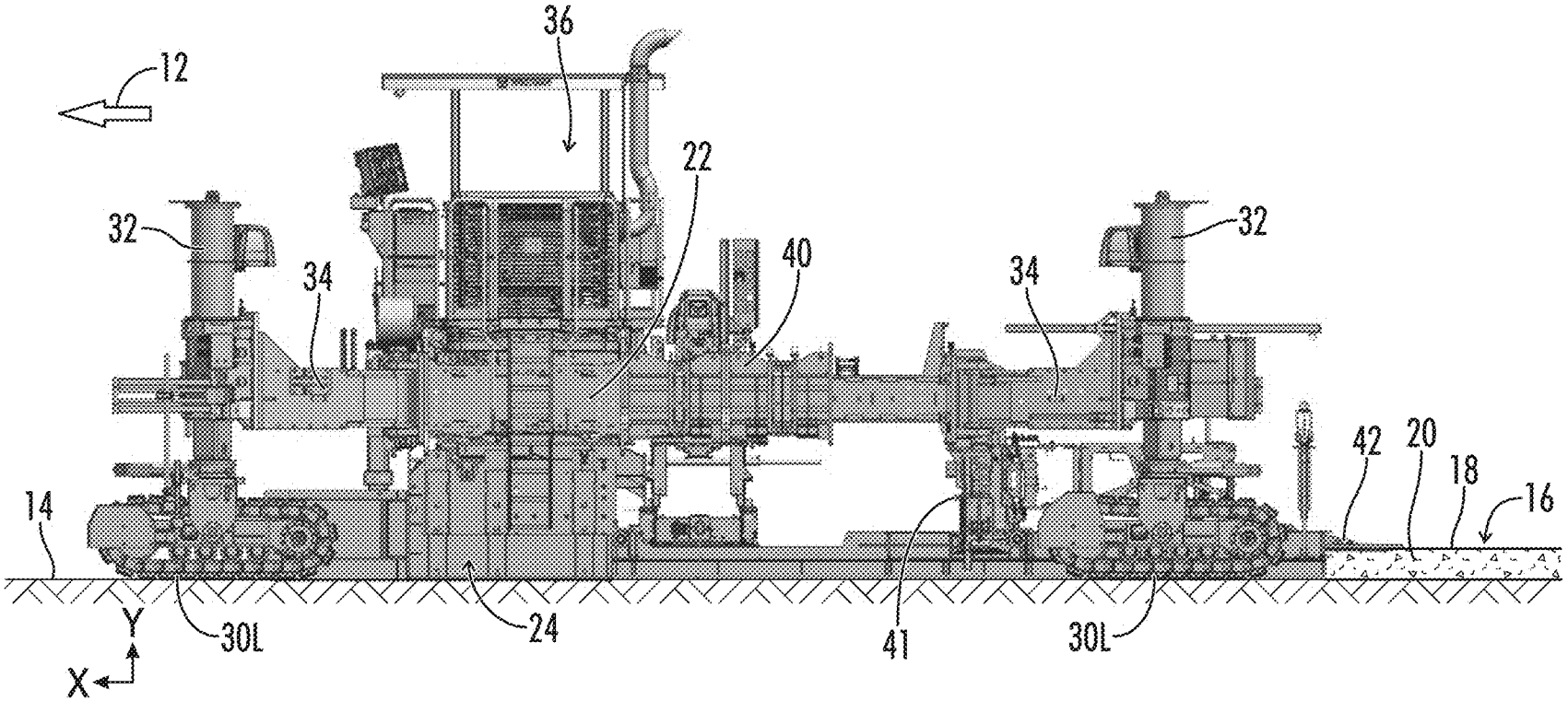
FIG. 2 is a left side elevation view of the slipform paver of FIG. 1.

Referring now to the drawings, and particularly to FIGS. 1 and 2, a slipform paver apparatus is shown and generally designated by the number 10. The details of construction of a typical slipform paver apparatus may be seen in U.S. Pat. No. 6,872,028 (WO 2002/101150) to Aeschlimann et al., which is incorporated herein by reference.

As is schematically illustrated in FIGS. 1 and 2 the apparatus 10 is configured to move in a paving direction 12 across a ground surface 14 for spreading, leveling and finishing concrete into a finished concrete structure 16 having a generally upwardly exposed concrete surface 18 and terminating in lateral concrete sides such as 20.

The slipform paver apparatus 10 includes a machine frame 22 and a slipform paver mold 24 supported from the machine frame 22. The machine frame 22 may also be referred to as a main frame. The slipform paver mold 24 may be referred to as an adjustable width mold apparatus 24.

The machine frame 22 is supported from the ground surface along left and right support paths 26 and 28 by a plurality of ground engaging units such as 30, which in the illustrated embodiment are tracked ground engaging units 30. Wheeled ground engaging units could also be used. The slipform paver 10 includes at least one left ground engaging unit 30L and at least one right ground engaging unit 30R. In the illustrated embodiment there are two left ground engaging units and two right ground engaging units. The slipform paver 10 is of the type generally referred to as an inset paver in which the slipform paver mold 24 is received below the machine frame 22 and generally between the left and right support paths 26 and 28 defined by the movement of the left and right ground engaging units. The terms left and right as used in this disclosure are with reference to the viewpoint of the human operator facing forward in the operating direction 12.

Each of the ground engaging units 30 is connected to the machine frame 22 by a lifting column such as 32 which may be attached to a swing arm such as 34. An operator's platform 36 is located on the machine frame 22. A plow or spreader device 38 may be supported from the machine frame 22 ahead of the slipform paver mold 24. Behind the slipform paver mold 24 a dowel bar inserter apparatus 40 may be provided. Behind the dowel bar inserter apparatus 40 an oscillating beam 41 and a super smoother apparatus 42 may be provided.

The machine frame 22 includes a plurality of laterally telescoping frame members such as 44 and 46 that allow a machine frame width 23 (see FIG. 4) of the machine frame 22 to be adjusted. The machine frame width 23 is transverse to the operating direction 12. The adjustment of the machine frame width may be accomplished using hydraulic ram frame actuators 48 and 50 embedded in the machine frame 22, or the traction power of the ground engaging units 30 may be used to extend and retract the machine frame 22. When the width of the machine frame 22 is adjusted it may also be necessary to adjust the width of the mold apparatus 24.

Figure 4:
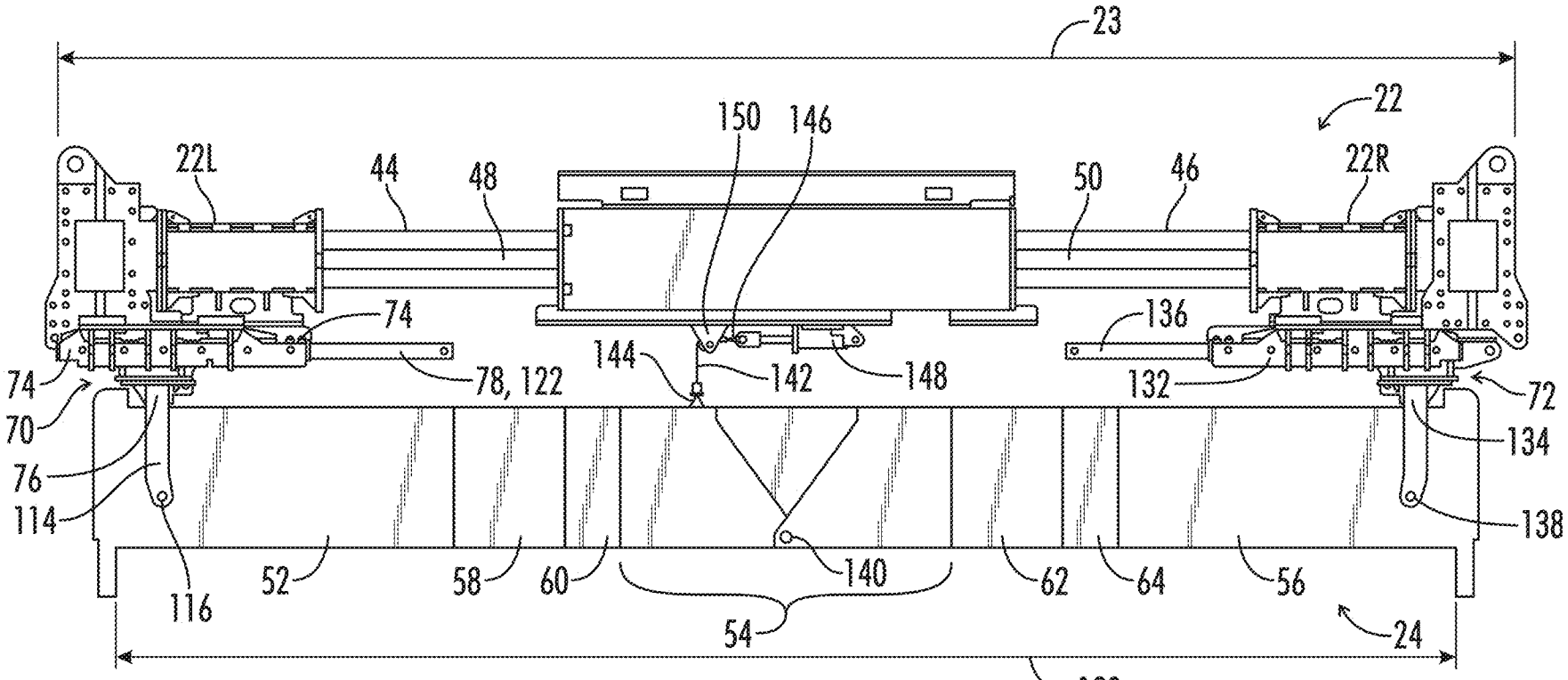
FIG. 4 is a schematic rear elevation view of the machine frame, the left and right suspension assemblies and the adjustable width mold in a fully extended configuration.

As schematically shown in FIG. 4 the adjustable width mold 24 may include a left sideform assembly 52, a center portion 54 and a right sideform assembly 56. One or more left spacers 58 and 60 may be configured to be received between the left sideform assembly 52 and the center portion 54. One or more right spacers 62 and 64 may be configured to be received between the center portion and the right sideform assembly 56.

Figure 3:
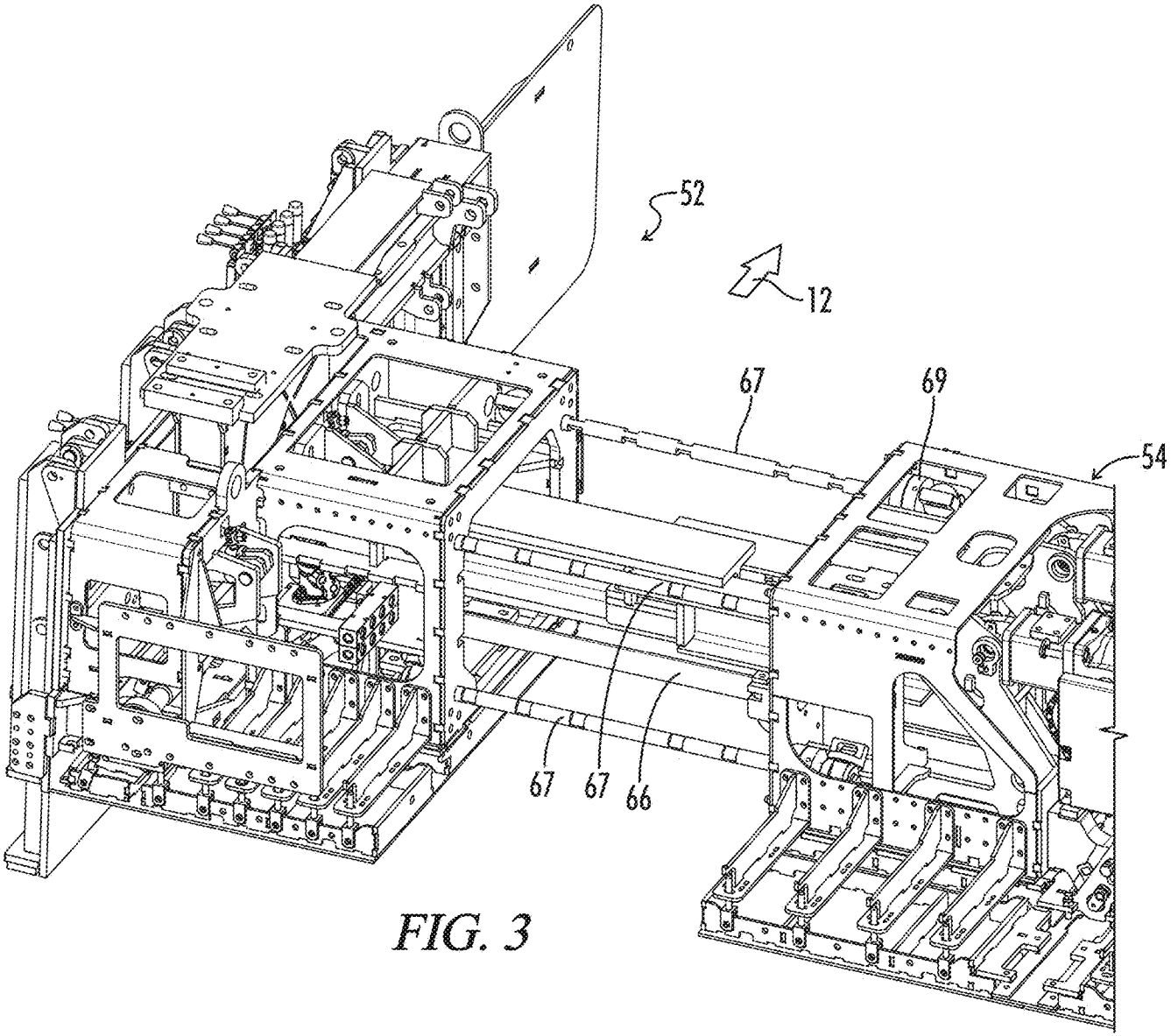
FIG. 3 is an enlarged rear perspective view of the left sideform assembly and the center portion of the adjustable width mold apparatus.
Figure 12:
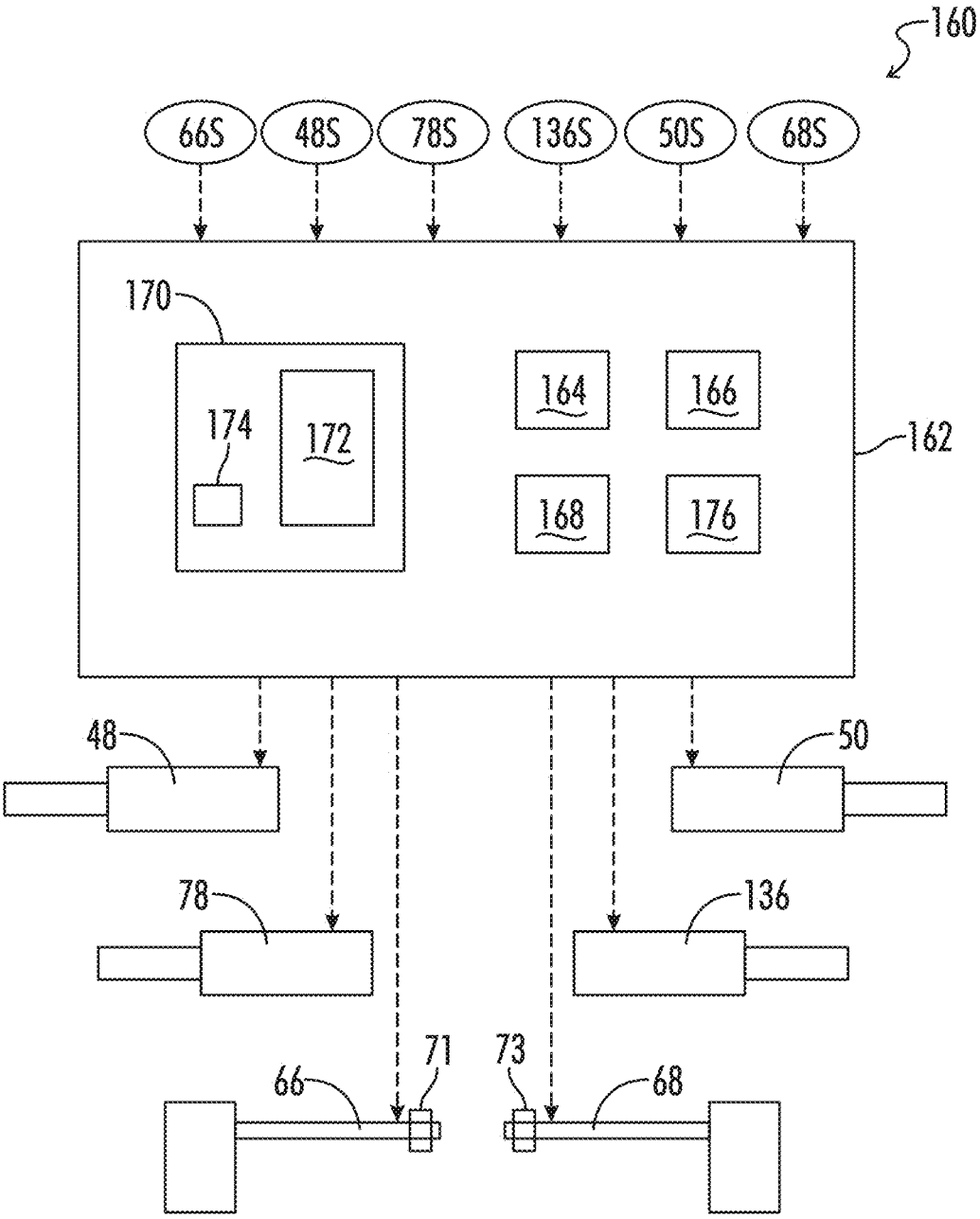
FIG. 12 is a schematic drawing of the controller and the various sensors and actuators of the slipform paver.

The construction of the adjustable width mold 24 including the details of the left sideform assembly 52, the center portion 54, the right sideform assembly 56, and all of the spacers 58-62 may be generally in accordance with the teachings of U.S. Patent Application Publication No. 2021/0172131, the details of which are incorporated herein by reference. FIG. 3 is a rear perspective view of the left sideform assembly 52 and center portion 54 taken from the aforesaid U.S. Patent Application Publication No. 2021/0172131, and showing the left side spacers 58 and 60 having been removed. In FIG. 3 the left sideform assembly 52 has not yet been moved into engagement with the center portion 54, and a left side mold actuator 66 connected between the left sideform assembly 52 and the center portion 54 is visible. Also visible are spacer hanger rods 67 which may have hydraulic nuts 69 on their ends for use in holding the left sideform assembly 52 against the center portion 54 or against any spacers therebetween. In the schematic control system drawing of FIG. 12 a similarly constructed right side mold actuator 68 is shown. As is further described below the left and right mold actuators 66 and 68 are configured to move their respective sideform assemblies 52 and 54 toward and away from the center portion 54. The mold actuators 66 and 68 may be hydraulically powered rotary spindles mounted in their respective sideform assemblies and engaging threaded nuts 71, 73 fixed to the center portion 54 as schematically shown in FIG. 12 and as described in detail the aforesaid U.S. Patent Application Publication No. 2021/0172131.

The difference between the adjustable width mold 24 of the present disclosure and the adjustable width mold of the aforesaid U.S. Patent Application Publication No. 2021/0172131 lies in the manner in which the mold is supported from the machine frame 22. In the aforesaid U.S. Patent Application Publication No. 2021/0172131 the left and right sideform assemblies of the mold are fixedly attached to the machine frame and they move with the machine frame when a width of the machine frame is adjusted. In the present disclosure, however, the left and right sideform assemblies 52 and 56 are suspended from the machine frame 22 by left and right suspension assemblies 70 and 72. The left suspension assembly 70 suspends the left sideform assembly 52 from the machine frame 22 such that the left sideform assembly 52 is movable relative to the machine frame 22. The right suspension assembly 72 suspends the right sideform assembly 56 from the machine frame 22 such that the right sideform assembly 56 is movable relative to the machine frame 22. The left and right suspension assemblies 70 and 72 may also be referred to as first and second suspension assemblies 70 and 72.

Figure 8:
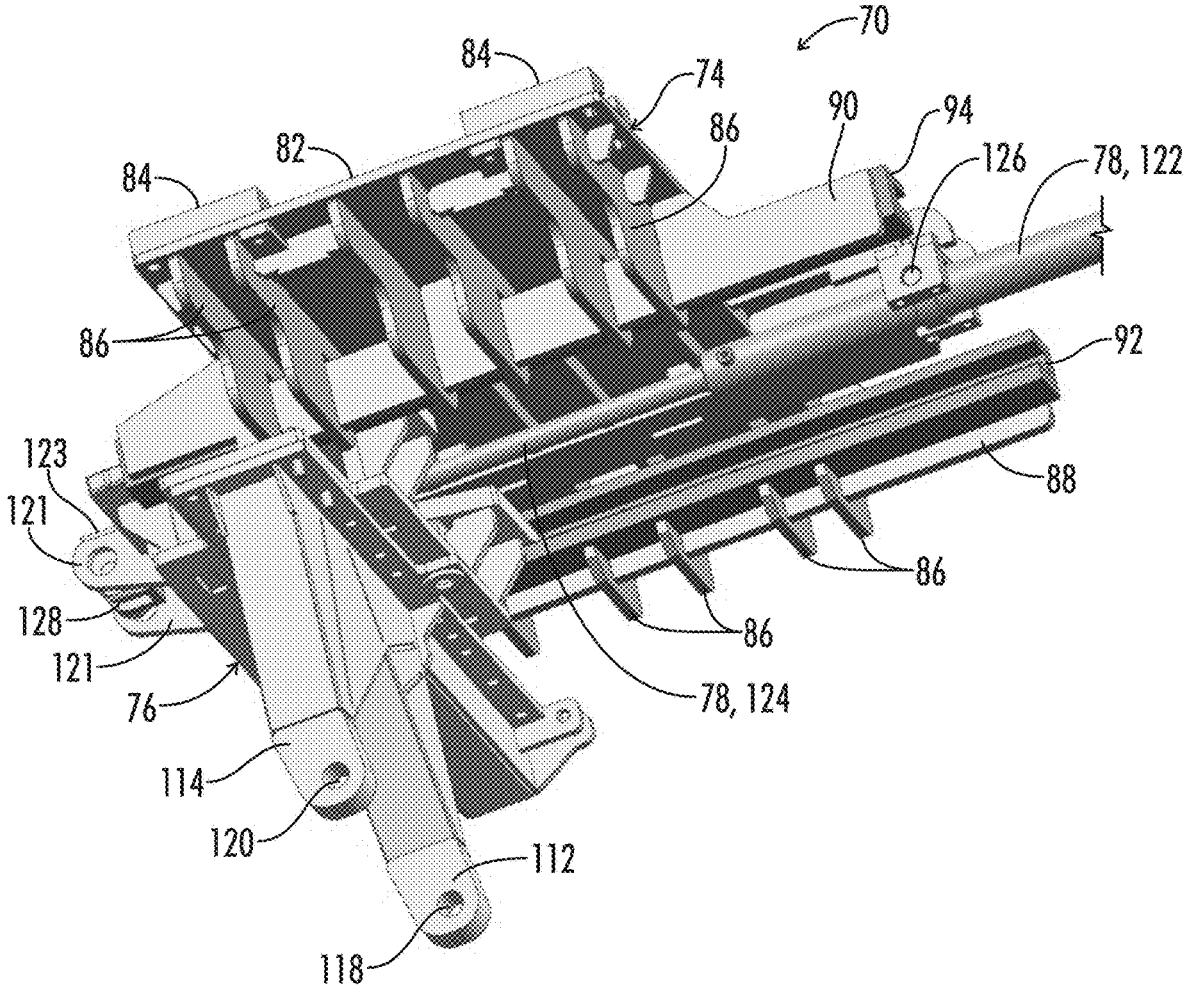
FIG. 8 is a lower rear perspective view of the left suspension assembly.
Figure 9:
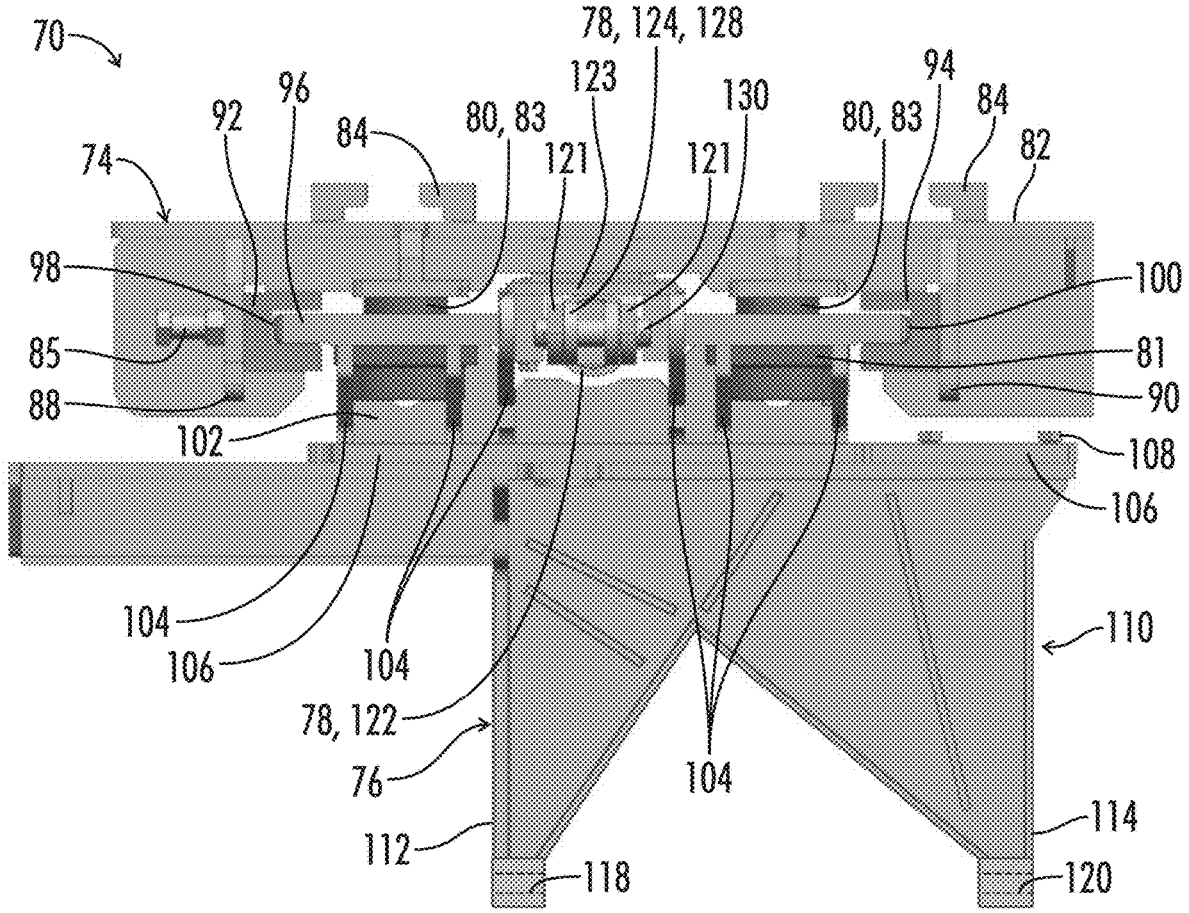
FIG. 9 is a left end elevation view of the left suspension assembly of FIG. 8. The clamping cylinders of the left suspension assembly are shown in their locked position.

The details of construction of the left suspension assembly 70 are seen in FIGS. 8 and 9. The right suspension assembly 72 is generally a mirror image of the left suspension assembly 70. The left suspension assembly 70 includes a left suspension frame 74, a left carriage 76, a left suspension actuator 78 and a pair of left clamping cylinders 80.

The left suspension frame 74 includes an upper mounting plate 82. A plurality of mounting channels 84 extend upward from mounting plate 80 and are used to fixedly attach the upper mounting plate 82 to a left machine frame portion 22L (see FIG. 4). A plurality of longitudinally (front to rear) extending gusset plates 86 extend downward from upper mounting plate 82. A forward transverse gusset plate 88 and a rearward transverse gusset plate 90 extend downward from the upper mounting plate 82. Front and rear guides or guide channels 92 and 94 are attached to the forward and rearward transverse gusset plates 88 and 90, respectively. The guides 92 and 94 are also received in cutouts of the longitudinal gusset plates 86. Each of the guides 92 and 94 are C-shaped with their open sides facing each other.

The left carriage 76 includes an upper carriage guide plate 96 having front and rear edges 98 and 100 slidingly received in the front and rear guides 92 and 94, respectively. Longitudinal and transverse carriage gussets 102 and 104 extend down from guide plate 96 to a carriage mounting plate 106. The carriage mounting plate 106 is bolted by bolts 108 to a carriage body 110. The carriage body 110 includes front and rear carriage legs 112 and 114 which extend downward for connection to the left sideform assembly 52 of mold 24. As seen in FIG. 4, the carriage legs 112 and 114 are pivotally connected to left sideform assembly 52 by pivot pins 116. In FIG. 9 pin holes 118 and 120 are schematically shown in front and rear carriage legs 112 and 114 for receipt of the pins 116.

As seen in FIGS. 8 and 9 a pair of actuator mounting flanges 121 extend down from a horizontal plate 123 which spans between two of the transverse gussets 104 of the left carriage 76.

The left suspension actuator 78 may be embodied as a hydraulic smart cylinder 78 including a cylinder portion 122 and a piston portion 124 extending from the cylinder portion 122. The cylinder portion 122 may be pivotally mounted on the left suspension frame 74 at pivot pin 126 and projects transversely to the right from left suspension frame 74 as seen in FIGS. 4 and 8. The cylinder portion 122 cannot move relative to left suspension frame 74 other than a slight pivotal motion about pivot pin 126. The piston portion 124 as best seen in FIG. 9 extends to the left out of cylinder portion 122 and includes a yoke 128 which is attached to mounting flanges 121 by a pivot pin 130.

Thus, retraction of the piston portion 124 into the cylinder portion 122 moves the left carriage 76 from left to right as seen in FIG. 4 relative to the left suspension frame 74 and the machine frame 22. Extension of the piston portion 124 moves the left carriage 76 from right to left.

Figure 9A:
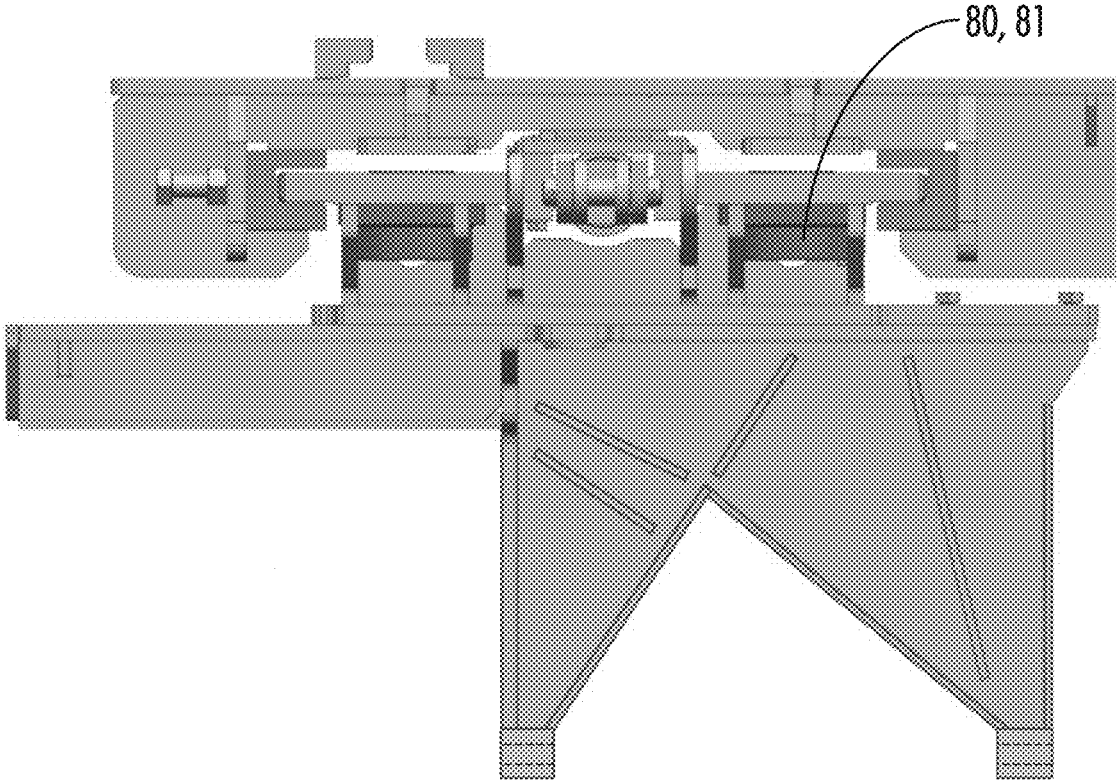
FIG. 9A is a view similar to FIG. 9 showing the clamping cylinders in a released position.

As seen in FIG. 9 the left suspension assembly 70 includes two of the clamping cylinders 80, on opposite sides of the left suspension actuator. The clamping cylinders 80 have a base portion 81 mounted in the left carriage 76, and a piston portion 83 extending upward. The clamping cylinders 80 are movable between a locked or clamped position as seen in FIG. 9, and a released position as seen in FIG. 9A. In the locked position the piston portions 83 are pressed upward into clamping engagement with the left suspension frame 74 to prevent movement of the left carriage 76 relative to the left suspension frame 74. In the released position of FIG. 9A the piston portions 83 are retracted and the left carriage 76 is free to slide along the guides 92 and 94 relative to the left suspension frame 74.

An additional provision is made for a further locking of the left carriage 76 relative to the left suspension frame 74 when the machine is in transport mode for transport from one job location to another. This additional provision is in the form of a plurality of locking bolts 85 (see FIG. 9) which are extendible through the guides 92 and/or 94 into locking engagement with the edges 98 and 100 of the upper carriage guide plate 96.

Similarly, the right suspension assembly 72 includes a right suspension frame 132, a right carriage 134, and right suspension actuator 136. The right carriage 134 is pivotally connected to the right sideform assembly 56 of mold 24 at pivotal connection 138.

Figure 10:
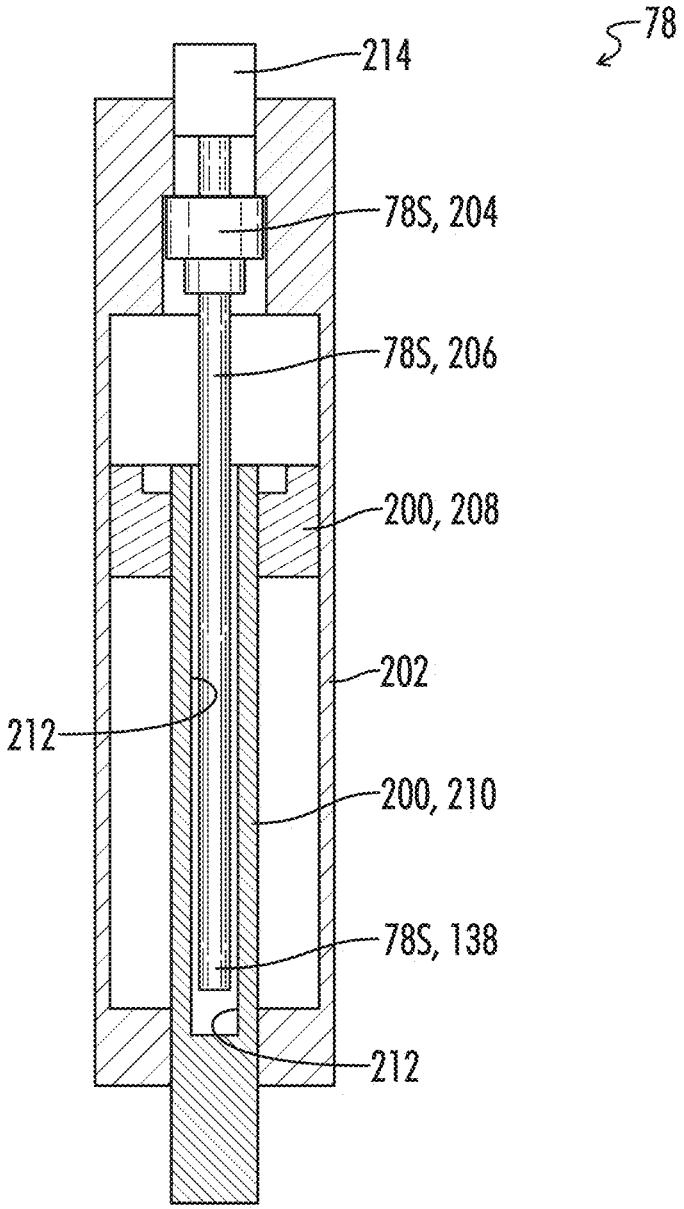
FIG. 10 is a schematic sectioned view of a hydraulic smart cylinder.

As noted, the left and right suspension actuators 78 and 136 may be hydraulic smart cylinders. A representative construction of such a "smart" hydraulic cylinder is shown in FIG. 10, and the details of a "smart" hydraulic suspension actuator 78 will be described by way of example. FIG. 10 may also be representative of the internal construction of any of the other actuators herein described when those actuators are implemented as "smart" cylinders. In the illustrated embodiment, the actuator 78 includes an integrated sensor 78S configured to provide a signal corresponding to an extension of a piston member 200 relative to a cylinder member 202 of the actuator 78.

The sensor 78S includes a position sensor electronics housing 204 and a position sensor coil element 206.

The piston portion 200 of actuator 78 includes a piston 208 and a rod 210. The piston 208 and rod 210 have a bore 212 defined therein, within which is received the position sensor coil element 206.

The actuator 78 is constructed such that a signal is provided at connector 214 representative of the position of the piston 208 relative to the position sensor coil element 206.

Such smart cylinders may operate on several different physical principles. Examples of such smart cylinders include but are not limited to magneto-strictive sensing, magneto-resistive sensing, resistive (potentiometric) sensing, Hall effect sensing, sensing using linear variable differential transformers, and sensing using linear variable inductance transducers.

The center portion 54 of mold 24 is configured to provide an adjustable crown angle to the paved surface. Center portion 54 includes a center pivot point 140. The pivot point 140 allows the two halves of the mold 24 extending to the left and right of pivot point 140 to pivot relative to each other. This can be accomplished either by raising the center portion 54 or by creating an angle within the center portion 54 using an actuator internal to the center portion 54. The pivotal motion of the two halves of the mold 24 is further permitted at their outer ends by the pivotal connections 116 and 138.

As seen in FIG. 4 the center portion 54 may be supported from the machine frame 22 by a support cable 142. Support cable 142 is attached at one end 144 to the center portion 54 and at another end 146 to a hydraulic cylinder actuator 148. The cable 142 extends over a guide roller 150. The actuator 148 can apply a tension load to the cable 142 to aid in supporting the center portion 54 during set-up.

Control System:

As schematically illustrated in FIG. 12, the slipform paver 10 includes a control system 160 including a controller 162. The controller 162 may be part of the machine control system of the slipform paver 10, or it may be a separate control module. The controller 162 may for example be mounted in a control panel located at the operator's station 36. The controller 162 is configured to receive input signals from the various sensors. The signals transmitted from the various sensors to the controller 162 are schematically indicated in FIG. 12 by lines connecting the sensors to the controller with an arrowhead indicating the flow of the signal from the sensor to the controller 162.

For example, extension signals from the extension sensors such as 78S and 136S associated with the "smart" suspension actuators 78 and 136 will be received so that the controller 162 can monitor and control the operation of the suspension actuators. There may be similar input signals from sensors 48S and 50S representative of the extension of the actuators 48 and 50 for the extension of machine frame 22. There may be further sensors 66S and 68S associated with the rotary spindle actuators 66 and 68 of the mold 24.

Similarly, the controller 162 will generate control signals for controlling the operation of the various actuators discussed above, which control signals are indicated schematically in FIG. 12 by lines connecting the controller 162 to graphic depictions of the various actuators with the arrow indicating the flow of the command signal from the controller 162 to the respective actuators. It will be understood that for control of a hydraulic cylinder type actuator the controller 162 will send an electrical signal to an electro/mechanical control valve (not shown) which controls flow of hydraulic fluid to and from the hydraulic cylinder.

Figure 11:
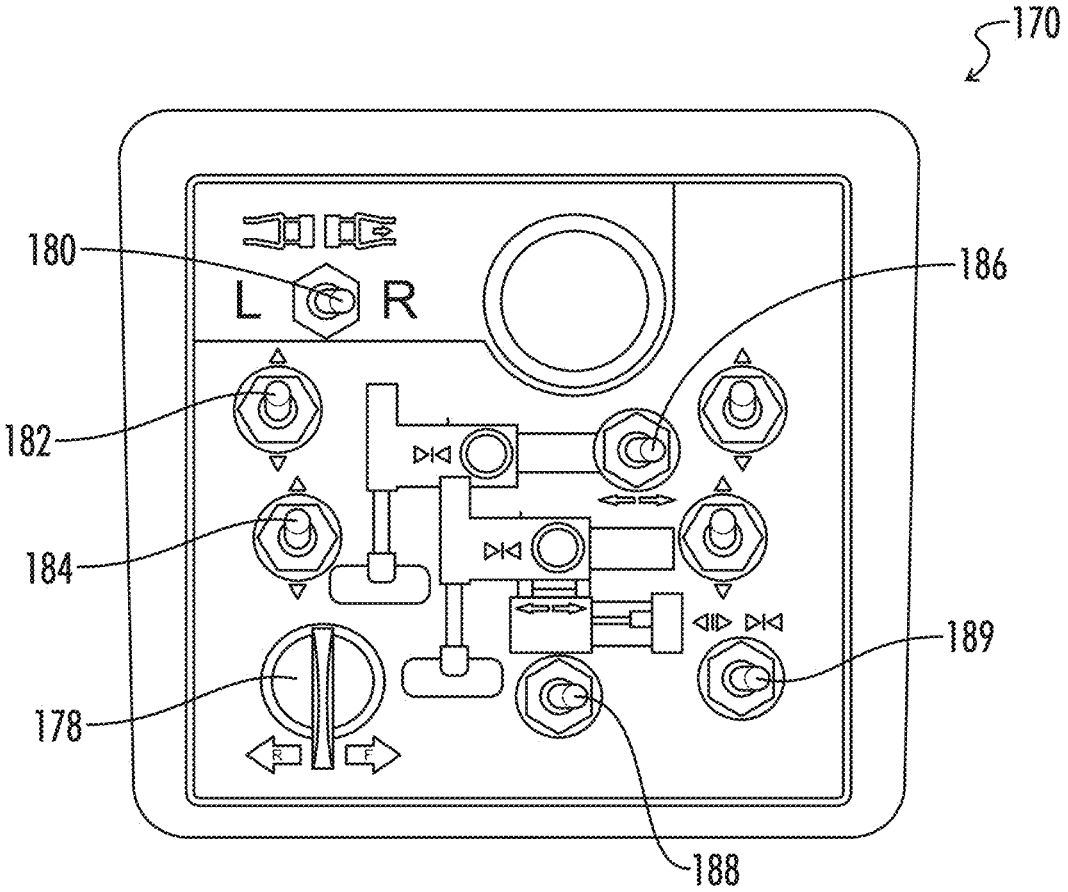
FIG. 11 is a schematic view of a control input panel which allows the human operator to input control commands to the controller.

Controller 162 includes or may be associated with a processor 164, a computer readable medium 166, a data base 168 and an input/output module or control panel 170 having a display 172. An input/output device 174, such as a keyboard, joystick or other user interface, is provided so that the human operator may input instructions to the controller. Further details of one embodiment of the control panel 170 are seen in FIG. 11. It is understood that the controller 162 described herein may be a single controller having all of the described functionality, or it may include multiple controllers wherein the described functionality is distributed among the multiple controllers.

Various operations, steps or algorithms as described in connection with the controller 162 can be embodied directly in hardware, in a computer program product 176 such as a software module executed by the processor 164, or in a combination of the two. The computer program product 176 can reside in RAM memory, flash memory, ROM memory, EPROM memory, EEPROM memory, registers, hard disk, a removable disk, or any other form of computer-readable medium 166 known in the art. An exemplary computer-readable medium 166 can be coupled to the processor 164 such that the processor can read information from, and write information to, the memory/storage medium. In the alternative, the medium can be integral to the processor. The processor and the medium can reside in an application specific integrated circuit (ASIC). The ASIC can reside in a user terminal. In the alternative, the processor and the medium can reside as discrete components in a user terminal.

The term "processor" as used herein may refer to at least general-purpose or specific-purpose processing devices and/or logic as may be understood by one of skill in the art, including but not limited to a microprocessor, a microcontroller, a state machine, and the like. A processor can also be implemented as a combination of computing devices, e.g., a combination of a DSP and a microprocessor, a plurality of microprocessors, one or more microprocessors in conjunction with a DSP core, or any other such configuration.

FIG. 11 shows further details of the control panel 170. Input switch 178 controls the forward or rearward direction of the ground engaging units 30.

Toggle switch 180 is a three position switch which selects whether the other chosen inputs apply to the left side, the right side or both sides. A center position of switch 180 causes the subsequently selected action to apply to both sides of the slipform paver 10.

Switches 182 and 184 are up and down controls for the lifting columns 32 on the selected side of the machine 10.

Switch 186 extends and retracts the selected telescoping actuators 48 and 50 (see FIG. 4) of the machine frame 22.

Switch 188 extends and retracts the selected left and/or right suspension actuators 78 and 136.

Switch 189 extends and retracts the selected left or right rotary spindle mold actuators 66.

Methods of Operation:

The slipform paver 10 provides an adjustable width mold 24 that is suspended from the machine frame 22 by the left and right suspension assemblies 70 and 72 such that a mold width 190 of mold 24 is adjustable without adjusting the frame width 23 of the machine frame 22. For example, during a paving operation it might be desirable to temporarily change the paving width 190 to create acceleration and deceleration lanes.

Such operations are illustrated in FIGS. 4-7. FIG. 4 shows an adjustable width mold 24 in its fully extended position. It is noted that there are two left side spacers 58 and 60 between the left sideform assembly 52 and center portion 54, and there are two right side spacers 62 and 64 between the right sideform assembly 56 and the center portion 54. In this example the mold width 190 may be twenty-four feet, the spacers 58 and 62 may each be two feet wide, and the spacers 60 and 64 may each be one foot wide.

Figure 5:
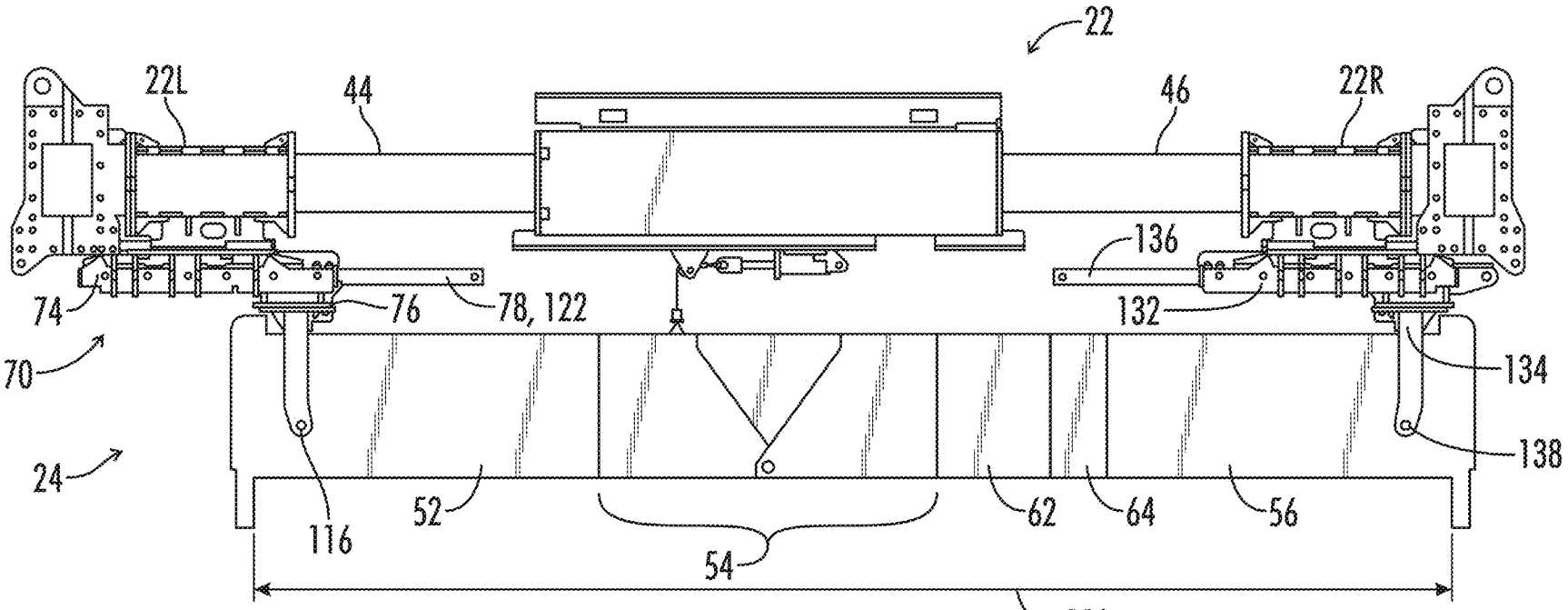
FIG. 5 is a view similar to FIG. 4 in which the left side spacers have been removed and the left suspension assembly and the left sideform assembly have been shifted to the right so that the left sideform assembly engages the center portion to shorten the left side of the adjustable width mold.

FIG. 5 illustrates a modification of the mold 24 to adjust the paving width 190 from twenty-four feet to twenty-one feet. This is accomplished in the following manner. The switch 180 is moved to the left position. The left mold actuator 66 and/or the associated hydraulic nuts 69 of the hanger rods 67 are released and the spacers 58 and 60 are removed. The switch 188 is moved to the right position to direct the left suspension actuator 78 to retract to move the left carriage 76 from left to right by a distance of three feet to move the left sideform assembly 52 into engagement with the center portion 54 thus closing the three foot gap created by the removal of spacers 58 and 60. This motion may be coordinated with the operation of the left mold actuator 66 and or the associated hydraulic nuts 69 of the hanger rods 67 by the controller 162 so that the left suspension actuator 78 and the left mold actuator 66 operate together to move the left carriage 76 and the left sideform assembly 52 relative to the machine frame 22. The operation of the left and right suspension actuators 78 and 136 may also be coordinated with the operation of the left and right actuators 48 and 50 of the telescoping machine frame 22.

In an embodiment any selected ones of the left and right actuators 48 and 50 of the telescoping machine frame 22, the left and right suspension actuators 78 and 136, and the left and right mold actuators 66 and 68 may be hydraulically unlocked or opened so that they are free to move with their connected components. For example, if it is desired to adjust the machine frame width 23 using the left and right actuators 48 and 50 it is possible to hydraulically unlock the left and right suspension actuators 78 and 136 and the left and right mold actuators 66 and 68 so that the left and right suspension actuators 78 and 136 and the left and right mold actuators 66 and 68 move freely along with the movement of the machine frame 22. As a further example if it is desired to adjust the mold width 190 with the left and/or right suspension actuators 78 and 136, the left and right mold actuators 66 and 68 may be hydraulically unlocked so that the left and right mold actuators 66 and 68 move freely along with the movement of the left and/or right suspension actuators 78 and 136. The controller 162 may coordinate such actions by controlling the hydraulic unlocking of the selected actuators. The controller 162 may also coordinate such actions by directing simultaneous powered operation of selected actuators.

The operation just described for moving the mold 24 from the configuration of FIG. 4 to that of FIG. 5 may be referred to as a left side operational mode in which the left suspension actuator 78 is operable to move the left carriage 76 and the left sideform assembly 52 relative to the machine frame 22 while the right carriage 134 and right sideform assembly 56 remain fixed relative to the machine frame 22. During the left side operational mode the clamping cylinders 80 of the left side suspension assembly 70 are in the released position and the clamping cylinders 80 of the right side suspension assembly 72 are locked.

The controller 162 is configured such that when the left suspension actuator 78 is operable to move the left carriage 76 relative to the left suspension frame 74, the clamping cylinders 80 of the left suspension assembly 70 are released to allow that sliding movement of the left carriage. When the left suspension actuator is not operating to move the left carriage 76 the clamping cylinders 80 are moved back into their locked positions to prevent any inadvertent sliding movement of the left carriage 76.

Figure 6:
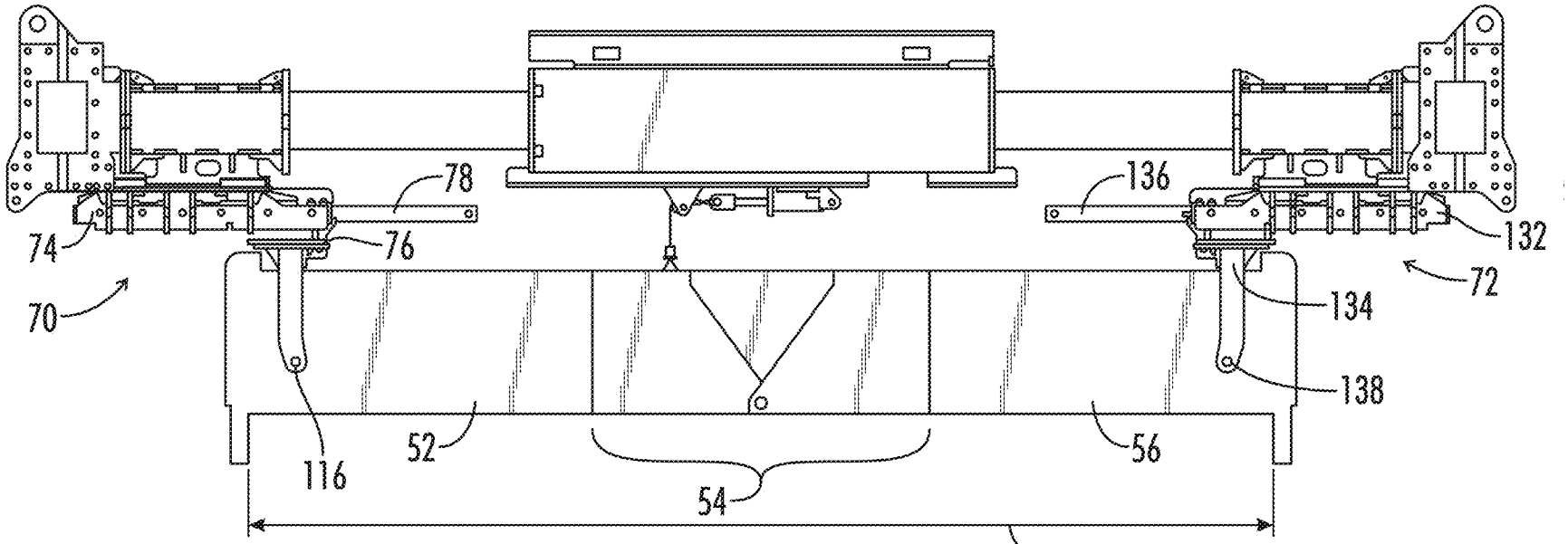
FIG. 6 is a view similar to FIGS. 4 and 5 in which the right side spacers have also been removed and the right suspension assembly and the right sideform assembly have been shifted to the left so that the right sideform assembly also engages the center portion to shorten the right side of the adjustable width mold.

FIG. 6 illustrates a further modification of the mold 24 to adjust the paving width 190 from twenty-one feet to eighteen feet. This is accomplished in a manner similar to that described above, in this case using the right suspension assembly 72 to move the right sideform assembly 56 to the left by three feet after removal of the spacers 62 and 64.

The operation just described for moving the mold 24 from the configuration of FIG. 5 to that of FIG. 6 may be referred to as a right side operational mode in which the right suspension actuator 136 is operable to move the right carriage 134 and the right sideform assembly 56 relative to the machine frame 22 while the left carriage 76 and left sideform assembly 52 remain fixed relative to the machine frame 22. Of course such a right side operation mode may be performed without having first adjusted the position of the left sideform assembly 54. During the right side operational mode the clamping cylinders 80 of the right side suspension assembly 72 are in the released position and the clamping cylinders 80 of the left side suspension assembly 70 are locked.

The controller 162 may be described as being configured such that each of the first and second suspension actuators 78 and 136 are independently operable to move the associated one of the left and right sideform assemblies 52 and 56, respectively, relative to the machine frame 22 to adjust the mold width 190.

Figure 7:
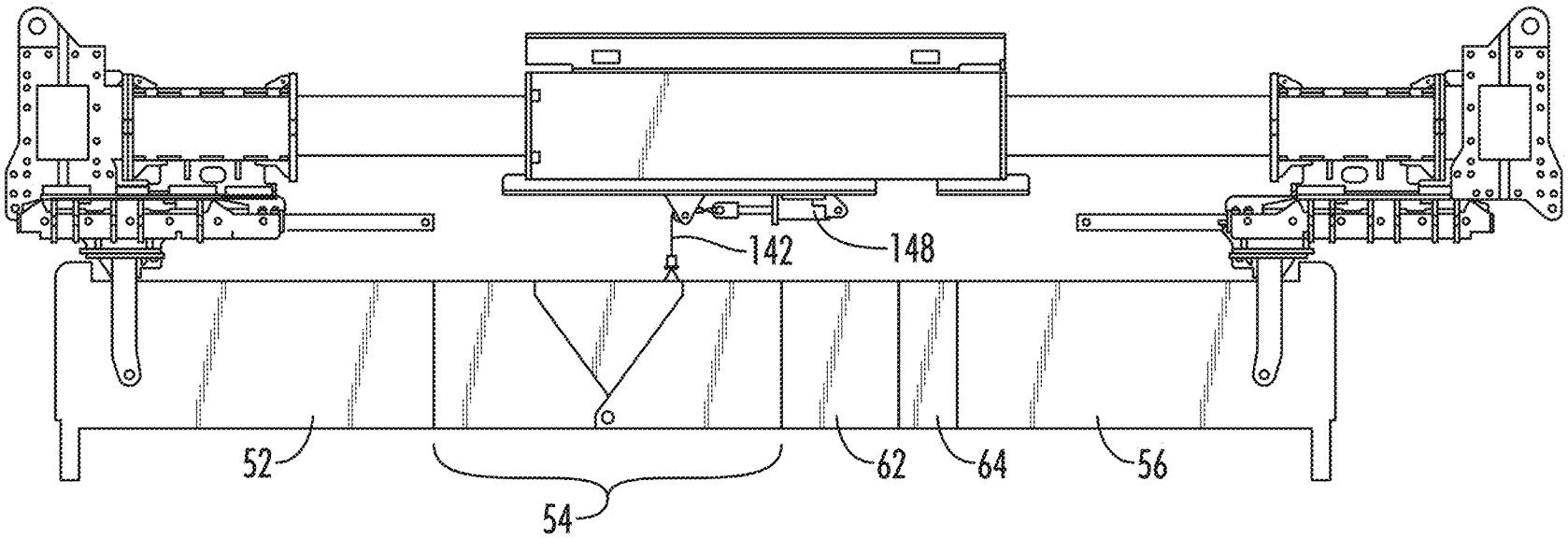
FIG. 7 is a view similar to FIG. 5 in which both the left and right suspension assemblies have shifted the entire mold from the position of FIG. 5 to the left into the position of FIG. 7 without adjusting the width of the mold.

Also it is possible to move from the orientation of FIG. 5 to that of FIG. 7 by shifting the entire mold 24 of FIG. 5 three feet to the left to the position of FIG. 7. This is accomplished as follows. First the switch 180 is moved to its middle position to select simultaneous operation of the left and right sides. Then switch 188 is moved to the left which causes simultaneous extension of the left suspension actuator 78 by three feet and retraction of the right suspension actuator 136 by three feet. Also, to accommodate the lateral movement of the center portion 54 the cable 142 may be disconnected at 144 prior to the lateral movement, and then reconnected to a different point on the center portion 54 after the lateral movement. The operation just described of moving from the orientation of FIG. 5 to the orientation of FIG. 7 may be described as a mold shifting operational mode in which one of the left and right suspension actuators 78, 136 extends while the other of the left and right suspension actuators retracts to transversely shift a position of the mold 24 relative to the machine frame 22 without adjusting the mold width 190. During the mold shifting mode the clamping cylinders 80 of both the left and right suspension assemblies 70 and 72 are in the released position.

With regard to this mold shifting operational mode the controller 162 may be described as being configured such that both of the first and second suspension actuators 78 and 136 are simultaneously operable to laterally shift the mold 24 relative to the machine frame 22 without adjusting the mold width 190.

The operations described above as the left side operational mode and the right side operational mode may be described as including a method of adjusting the mold width 190 of the mold 24 without adjusting the frame width 23 of the machine frame 22. This is illustrated by comparing FIG. 4 to FIG. 5, or by comparing FIG. 5 to FIG. 6.

This adjusting step may further be described as including laterally moving one or both of the sideform assemblies 52 and 56 relative to the center portion 54 without adjusting the frame width 23 of the machine frame 22.

The method may further include a step of laterally shifting a position of the mold 24 relative to the machine frame 22 without adjusting the frame width 23 of the machine frame 22, such as in the mold shifting mode described above. This is illustrated by comparing FIG. 5 to FIG. 7.

All of these methods may be further implemented under partial or complete control of the controller 162.

Thus, it is seen that the apparatus and methods of the embodiments disclosed herein readily achieve the ends and advantages mentioned as well as those inherent therein. While certain preferred embodiments have been illustrated and described for purposes of the present disclosure, numerous changes in the arrangement and construction of parts and steps may be made by those skilled in the art, which changes are encompassed within the scope and spirit of the present invention as defined by the appended claims

What is claimed is:

1. An inset slipform paver, comprising:

a machine frame;

at least one left ground-engaging unit and at least one right ground engaging unit configured to support the machine frame from a ground surface along left and right support paths such that a forward operating direction of the machine frame is defined and such that the machine frame has a frame width transverse to the forward operating direction; and an adjustable width mold suspended from the machine frame between the left and right support paths such that a mold width of the adjustable width mold is adjustable without adjusting the frame width of the machine frame, the adjustable width mold including:

a center portion;

a left sideform assembly;

a right sideform assembly;

one or more left spacers configured to be received between the left sideform assembly and the center portion; and one or more right spacers configured to be received between the right sideform assembly and the center portion.

2. The slipform paver of claim 1, wherein the adjustable width mold further comprises:

a left side mold actuator connected between the left sideform assembly and the center portion to move the left sideform assembly relative to the center portion; and a right side mold actuator connected between the right sideform assembly and the center portion to move the right sideform assembly relative to the center portion.

3. The slipform paver of claim 1, further comprising:

a left suspension assembly suspending the left sideform assembly from the machine frame such that the left sideform assembly is movable relative to the machine frame; and a right suspension assembly suspending the right sideform assembly from the machine frame such that the right sideform assembly is movable relative to the machine frame.

4. An inset slipform paver, comprising:

a machine frame;

at least one left ground-engaging unit and at least one right ground engaging unit configured to support the machine frame from a ground surface along left and right support paths such that a forward operating direction of the machine frame is defined and such that the machine frame has a frame width transverse to the forward operating direction;

an adjustable width mold suspended from the machine frame between the left and right support paths such that a mold width of the adjustable width mold is adjustable without adjusting the frame width of the machine frame, the adjustable width mold including a center portion, a left sideform assembly and a right sideform assembly;

a left suspension assembly suspending the left sideform assembly from the machine frame such that the left sideform assembly is movable relative to the machine frame; and a right suspension assembly suspending the right sideform assembly from the machine frame such that the right sideform assembly is movable relative to the machine frame;

wherein the left suspension assembly includes:

a left suspension frame fixedly attached to the machine frame and including a guide;

a left carriage movably engaged with the guide so that the left carriage is movable relative to the left suspension frame along the guide, the left carriage being connected to the left sideform assembly; and a left suspension actuator configured to move the left carriage and the left sideform assembly relative to the machine frame.

5. The slipform paver of claim 4, wherein:

the center portion is configured to provide an adjustable crown angle to the mold; and the left carriage is pivotably connected to the left suspension assembly.

6. The slipform paver of claim 4, wherein the left suspension assembly further comprises:

a clamping cylinder configured to lock the left carriage in place relative to the left suspension frame.

7. The slipform paver of claim 4, wherein the right suspension assembly further comprises:

a right suspension frame fixedly attached to the machine frame and including a guide;

a right carriage movably engaged with the guide so that the right carriage is movable relative to the right suspension frame along the guide, the right carriage being connected to the right sideform assembly; and a right suspension actuator configured to move the right carriage and the right sideform assembly relative to the machine frame.

8. The slipform paver of claim 7, further comprising:

a controller operably associated with the left and right suspension actuators, the controller being configured such that a human operator can select between:

a left side operational mode in which the left suspension actuator is operable to move the left carriage and the left sideform assembly relative to the machine frame while the right carriage and right sideform assembly remain fixed relative to the machine frame;

a right side operational mode in which the right suspension actuator is operable to move the right carriage and the right sideform assembly relative to the machine frame while the left carriage and left sideform assembly remain fixed relative to the machine frame; and a mold shifting operational mode in which one of the left and right suspension actuators extends while the other of the left and right suspension actuators retracts to transversely shift a position of the mold relative to the machine frame without adjusting the mold width.

9. The slipform paver of claim 8, wherein:

the left suspension assembly further includes a left clamping cylinder configured to have a locked position locking the left carriage in place relative to the left suspension frame;

the right suspension assembly further includes a right clamping cylinder configured to have a locked position locking the right carriage in place relative to the right suspension frame; and the controller is configured such that:

during the left side operational mode the left clamping cylinder is released to unlock the left carriage and the right clamping cylinder is in the locked position;

during the right side operational mode the right clamping cylinder is released to unlock the right carriage and the left clamping cylinder is in the locked position; and during the mold shifting mode both the left and right clamping cylinders are released to unlock the left and right carriages.

10. The slipform paver of claim 7, wherein:

the left and right suspension actuators are left and right hydraulic smart cylinders.

11. An inset slipform paver, comprising:

a machine frame;

at least one left ground-engaging unit and at least one right ground engaging unit configured to support the machine frame from a ground surface;

an adjustable width mold including a left sideform assembly, a center portion and a right sideform assembly; and a first suspension assembly including:

a first carriage movably mounted on the machine frame such that the first carriage is laterally movable relative to the machine frame, the first carriage being connected to one of the left and right sideform assemblies; and a first suspension actuator configured to move the first carriage and the one of the left and right sideform assemblies relative to the machine frame.

12. The slipform paver of claim 11, further comprising:

a second suspension assembly including:

a second carriage movably mounted on the machine frame such that the second carriage is laterally movable relative to the machine frame, the second carriage being connected to the other of the left and right sideform assemblies; and a second suspension actuator configured to move the second carriage and the other of the left and right sideform assemblies relative to the machine frame.

13. The slipform paver of claim 12, further comprising:

a controller operably associated with the first and second suspension actuators, the controller being configured such that each of the first and second suspension actuators are independently operable to move the associated one of the left and right sideform assemblies relative to the machine frame to adjust a width of the mold.

14. The slipform paver of claim 12, wherein:

the controller is further configured such that both of the first and second suspension actuators are simultaneously operable to laterally shift the mold relative to the machine frame without adjusting the width of the mold.

15. The slipform paver of claim 11, wherein the adjustable width mold further comprises:

a first mold actuator connected between the center portion and one of the left and right sideform assemblies to move the one of the left and right sideform assemblies relative to the center portion; and a controller operably associated with the first mold actuator and with the first suspension actuator, the controller being configured to coordinate operation of the first mold actuator with the first suspension actuator so that the first mold actuator and the first suspension actuator operate together to move the first carriage and the one of the left left and right sideform assemblies relative to the machine frame.

* * * * *